US005701625A

United States Patent [19]

Siman

[11] Patent Number: 5,701,625

[45] Date of Patent: Dec. 30, 1997

[54] SCRUB CLEANING MACHINE

[76] Inventor: Walid Siman, 80 Riverbend Rd., Apt. #D, Stratford, Conn. 06497

[21] Appl. No.: 503,115

[22] Filed: Jul. 18, 1995

[51] Int. Cl.[6] ..... A46B 11/00

[52] U.S. Cl. ..... 15/21.1; 15/22.1; 15/29; 15/97.1; 401/268

[58] Field of Search ..... 15/21.1, 22.1, 15/29, 24, 28, 97.1; 366/129; 401/24, 289, 281, 268; 451/67, 461

[56] References Cited

U.S. PATENT DOCUMENTS

| | | | |
|---|---|---|---|
| 1,625,729 | 4/1927 | Carrington | 15/29 |
| 2,933,747 | 4/1960 | Higdon | 15/29 |
| 3,030,967 | 4/1962 | Peyron | 15/22.1 |
| 3,638,264 | 2/1972 | Walton | 15/29 |
| 3,943,591 | 3/1976 | Lanusse' | 15/29 |
| 4,137,588 | 2/1979 | Sandt et al. | 15/22.1 |
| 4,217,671 | 8/1980 | Rand | 15/29 |
| 4,254,526 | 3/1981 | Fromm | 15/29 |
| 4,335,481 | 6/1982 | Slayman | 15/29 |
| 4,408,623 | 10/1983 | Murray | 15/22.1 |
| 4,575,255 | 3/1986 | Kafka | 366/129 |
| 4,796,321 | 1/1989 | Lee | 15/29 |
| 5,423,102 | 6/1995 | Madison | 15/22.1 |

*Primary Examiner*—Tony Soohoo
*Attorney, Agent, or Firm*—Bachman & LaPointe, P.C.

[57] ABSTRACT

A multipurpose motorized cordless scrub cleaning machine is disclosed and is intended to reduce the effort in scrub cleaning jobs around the house or the work places for general cleaning by the usage of rotating pads or brushes. Water and detergent are conveniently supplied into the pads to clean dishes and perform scrub rinsing, too. It could also perform polishing and sanding jobs depending on the setting used in each function, and it could also carry an egg beater accessory.

5 Claims, 8 Drawing Sheets

SCRUB CLEANING MACHINE

BACKGROUND OF THE INVENTION

1—Scrub cleaning effort usually consists of two parts, first pressing the scrubbing pad against the surface and maintaining this pressure throughout the second stage, second scrubbing action through the surface. In the use of the scrubbing machine the first effort (pressing) will be reduced dramatically by the weight of the machine on one hand, and adding more effort by holding the machine, but the advantage is actually in the second effort where the scrubbing action is motorized completely. Note that a turning reaction tendency of the machine will occur with the increase of the first effort (pressing), this has to be overcome by a steady holding of the machine. Another accessory will be explained later to overcome this problem.

The idea behind the scrubbing machine is to reduce the efforts being made for scrub cleaning, scrubbing and washing dirty dishes, glasses, pots, pans, counters, oven surfaces, decks, furniture, car exteriors including tires and rims, and swimming pool walls. It is also intended for cars exterior polishing, and is capable of performing light duty sanding jobs prior to painting.

A set of accessories will be provided with the machine enabling the variety of jobs intended, including a set of brushes, sanding pads, polishing pads, and a water dispenser equipped with air-powered dispensing pump for full mobility.

Water supply, detergent dispenser, a motor, and rechargeable batteries are built into the machine, for accessible source of scrubbing power by the motor, an easy cleaning and rinsing accessibility by detergent and water.

SUMMARY OF THE INVENTION

1—Scrub cleaning job is a daily one in every house. The machine of the present invention will ease the job and encourage its practice to become more standard, This invention will provide an easy way to perform a cleaning job in general, more specifically scrub cleaning, and scrub rinsing, for example. It can provide an easier access to water, detergent, and scrubbing power to clean dishes, and rinse them, as well as glasses, pans, pots, trays, counters, ovens, floors, tiles, bath-tops, sinks, swimming pools, walls, decks, cars, and furniture, basically every surface that needs to be cleaned by scrubbing.

2—Another task is intended by a different set of accessories which is polishing in general, like furniture wood surfaces, and cars exterior.

3—This machine is also intended to be a light duty cordless sanding machine, to prepare wood surfaces for painting.

4—One more accessory will give the machine the duty of being an egg beater for every day use.

BRIEF DESCRIPTION OF THE DRAWINGS

A set of eight figures is provided to illustrate the intended invention, they are being described by figure order. Note that the right, left, top, and bottom, of the figures pages are intended be decided when placing the figure in a position where the numbers can be read.

Figure 1:
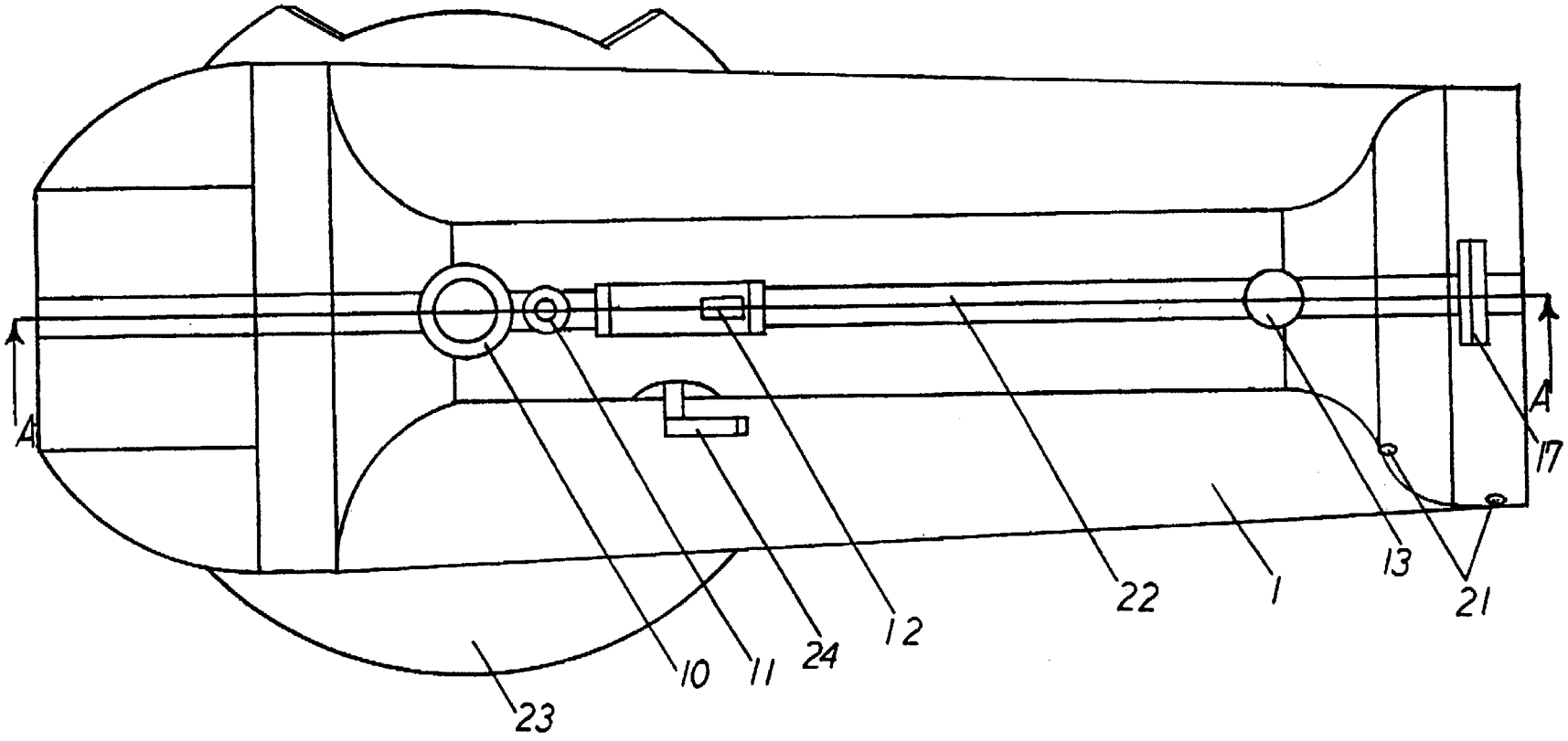
FIG. 1: represents a top view of this invention looking at the invention downward from the top of it.

FIGS. *5a* and *5b:* represent one model embodiment of the scrubbing pad, FIG. *5a* being a side sectional view of B—B, FIG. *5b* being a bottom view showing an upper part of the piece with the section B—B cut.

FIGS. *6a, 6b, 6c* and *6d:* show the mechanical pieces. FIGS. *6a* and *6b* show an extension pipe for deep scrubbing jobs, FIG. *6c* shows another model of scrubbing pad intended for narrow deep scrubbing jobs like cleaning glasses, and FIG. *6d* is a top view and shows the section C—C.

FIGS. *7a* and *7b:* show side and top views respectively of another accessory for the scrub cleaning machine of the present invention.

FIGS. *8a* and *8b:* represent another model of pads for polishing jobs, wherein similar pieces could be flattened on the bottom to perform sanding jobs.

DETAILED DESCRIPTION OF THE INVENTION

To ease the description of the intended invention, I'll start with a cross reference of the pieces and the components of invention, using their apparent numbers in the drawing.

Figure 2:
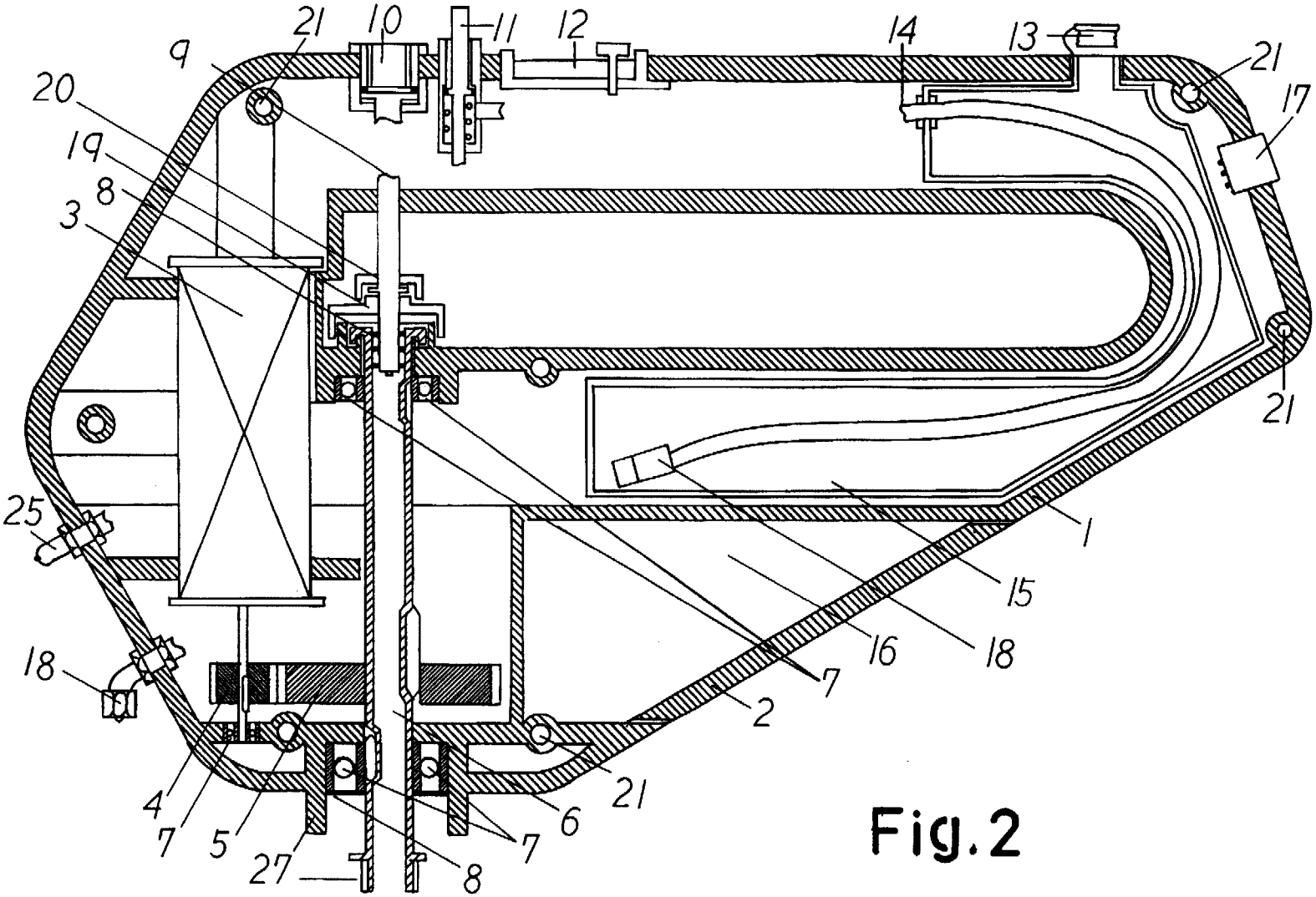
FIG. 2: is a sectional side view through the cut of A—A shown in FIG. 1, showing the inside, at one section, of the invention.
Figure 3:
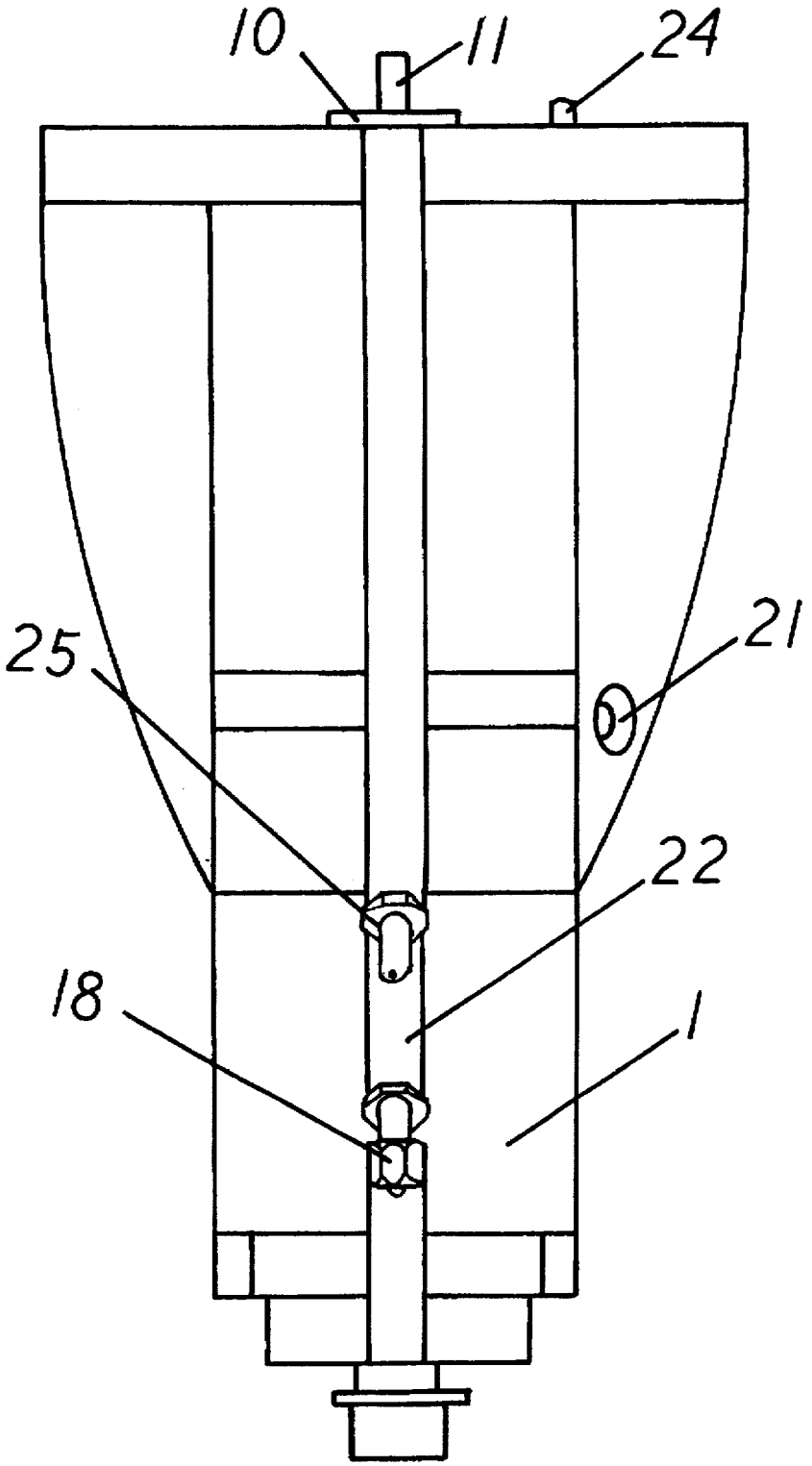
FIG. 3: is a face view of this invention looking from FIG. 1 into the invention from the middle left of FIG. 1.

1—Case made of either hard plastic or light metal (aluminum), consists of two parts, will be bounded together with fastening screws (screws are piece 21), shown in FIGS. 1,2,3.

2—Batteries cover made from the same casing material provided with seal to isolate the batteries compartment (shown as 16), shown in FIG. 2.

3—Electrical motor, direct current motor of low voltage suggested between 9–24 volts, preferably 12 volts, DC. Shown in FIG. 2.

4—Leading gear supplied with motion from the electrical motor driving shaft. Shown in FIG. 2 with its fastening stud to the driving shaft.

5—Driven gear, being supplied with power from the leading gear (4), and capable of driving the main shaft of the scrubbing machine (6). FIG. 2 shows the driving gear with the fastening stud against the machine driving shaft (6).

6—Drive shaft pipe shown in section in FIG. 2.

7—Bearings, shown for the motor driving shaft, and for the drive shaft pipe (6), one on top and the other on the bottom, representing regular ball bearing. FIG. 2.

8—Water seal, intended to seal water delivery into the drive shaft pipe (6). Shown in FIG. 2

9—Water and detergent delivery pipe, intended to deliver both, water and detergent in the drive shaft pipe. Shown in FIG. 2,4.

10—Water inlet fitting, intended to receive water through a flexible durable pipe from a sink source, mixer for both hot and cold. Shown in FIGS. 1,2,3,4.

11—Detergent pump, works on the principle of vacuum displacement through pumping on top in connection of two one way valves (18). FIGS. 1,2,3,4.

12—Motor switch, water resistant, allows the control of the operation and the speed of the electrical motor (3). FIGS. 1,2.

13—Detergent dispenser cap cover, to allow the addition of detergent in the dispenser. FIGS. 1,2.

Figure 4:
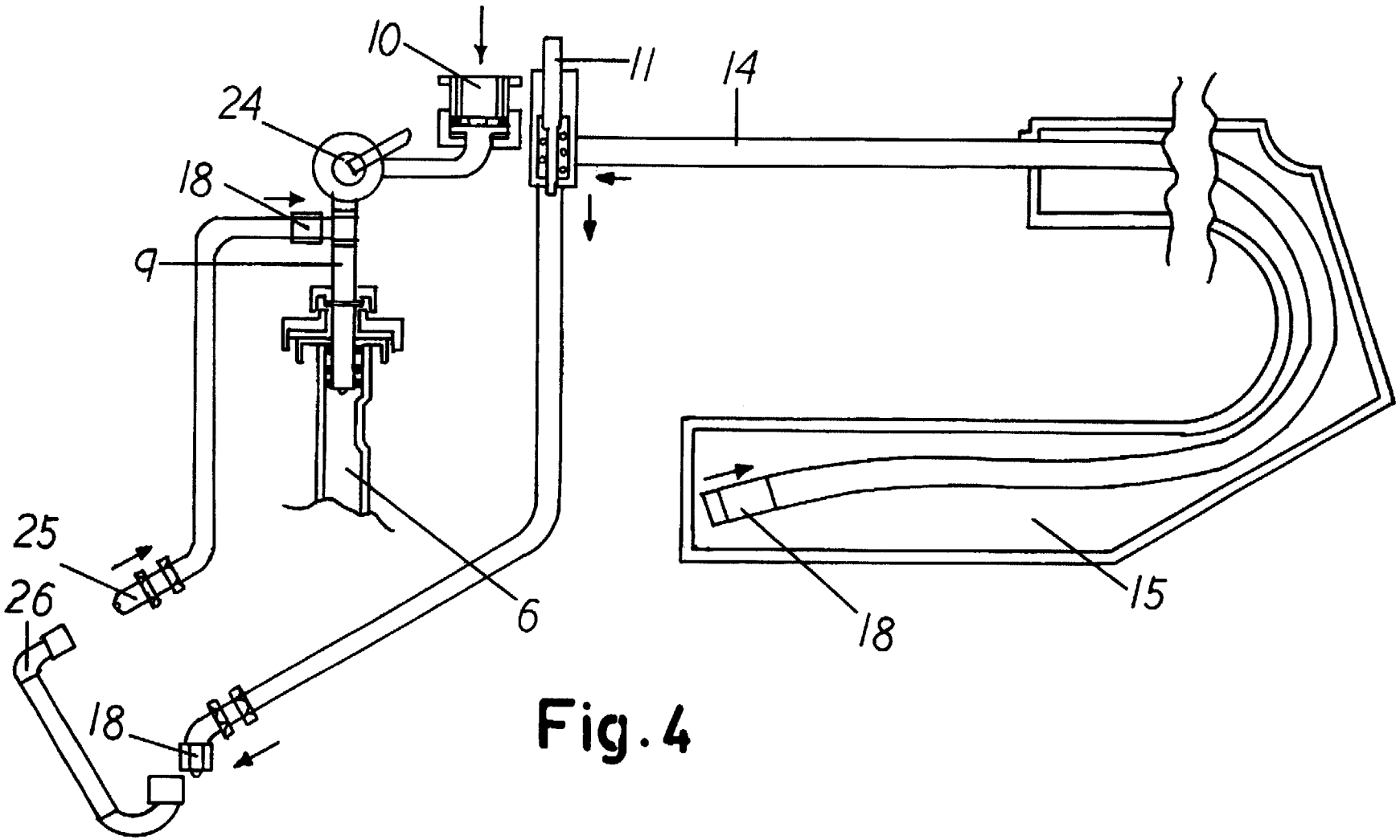
FIG. 4: shows the plumbing connection of the water, and the detergent connection and their relationship to each other inside the machine, and is intended to show the connections regardless of the geometry.

14—Detergent supply pipe, intended to deliver the detergent from the dispenser into the pump. FIGS. 2,4.

15—Detergent dispenser, for immediate convenient dispensing. FIGS. 2,4.

16—Batteries Case, contains rechargeable batteries, and could provide a supplement power to drive the motor. FIG. 2.

17—Power supply and charging inlet, intended to have removable wire connection to operate and charge the batteries. Complete water isolation is required and a durable flexible wire to be sought. FIGS. 1,2.

18—One way valve, four pieces in existence in the present invention. FIG. 4, including the piece numbered 25 for distinction. All work in connection with the detergent pump permitting flow in one direction only, direction of the flow shown in FIG. 4. FIGS. 2,4.

19—Cover cap, provided with holes to allow leakage, in case it happens to take place, outside the machine. FIG. 2.

20—Pipe fitting, intended to fasten water and detergent delivery pipe (9) in place. FIG. 2.

21—Assembly screws and holes, to fasten both part of the case (1) together. FIGS. 1,2,3.

22—Case water seal, to seal the two parts of the case (1) against water leakage placed between the two parts. FIGS. 1,3.

Figure 7A:
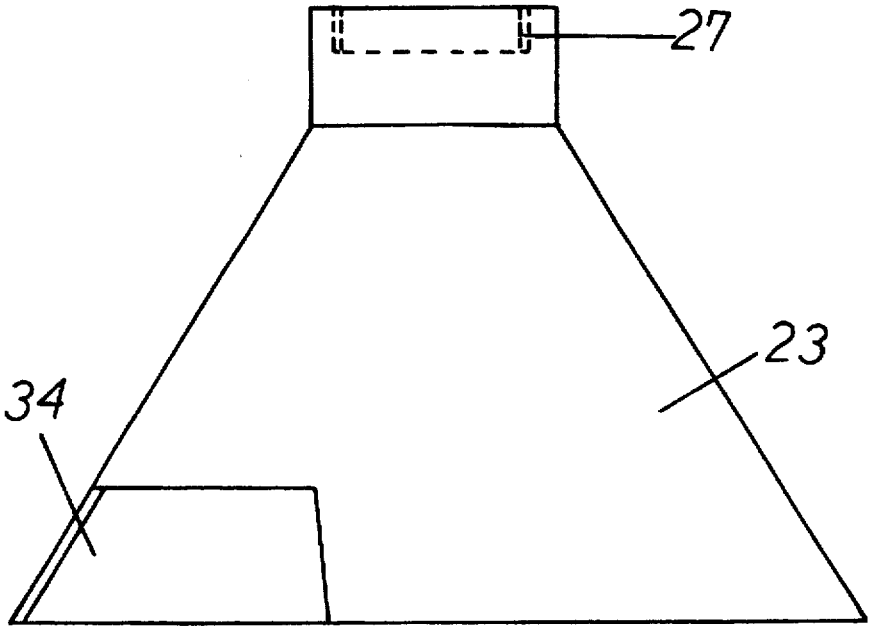
Figure 7B:
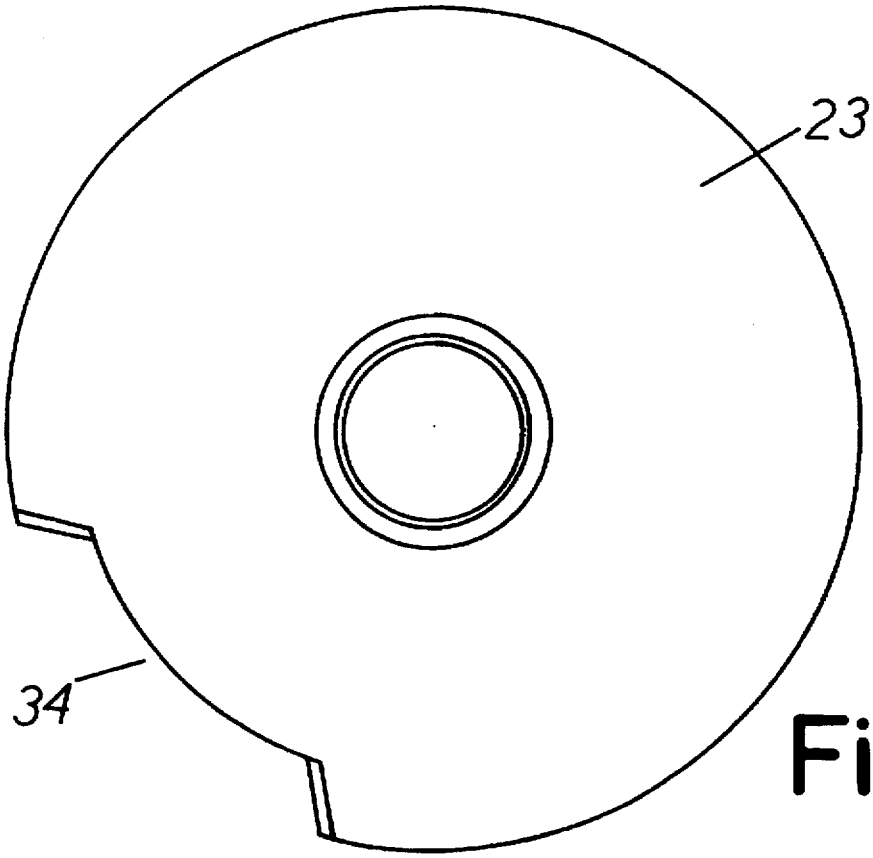

23—Splash protection cone, made of a flexible rubber intended to direct cleaning water in the opposite direction of the operator through an outlet shown in FIGS. 1,7.

24—Water valve, to control the water flow flux conveniently made of a durable ball-valve, shown in FIGS. 1,3,4.

25—Return valve, one way bypass valve allows the flow of detergent to reach inside of the scrubbing pad through pipes number (9) and (6). FIGS. 2,4.

26—Bypass attachment pipe, a separate pipe which can be hooked on to allow the flow of detergent to reach the inside of the scrubbing pad instead of dispensing outside the machine. FIG. 4.

27—Mounting thread, allows the mounting of both the scrubbing pad and the splash protecting cone. FIGS. 2,5,6, 7,8.

Figure 5A:
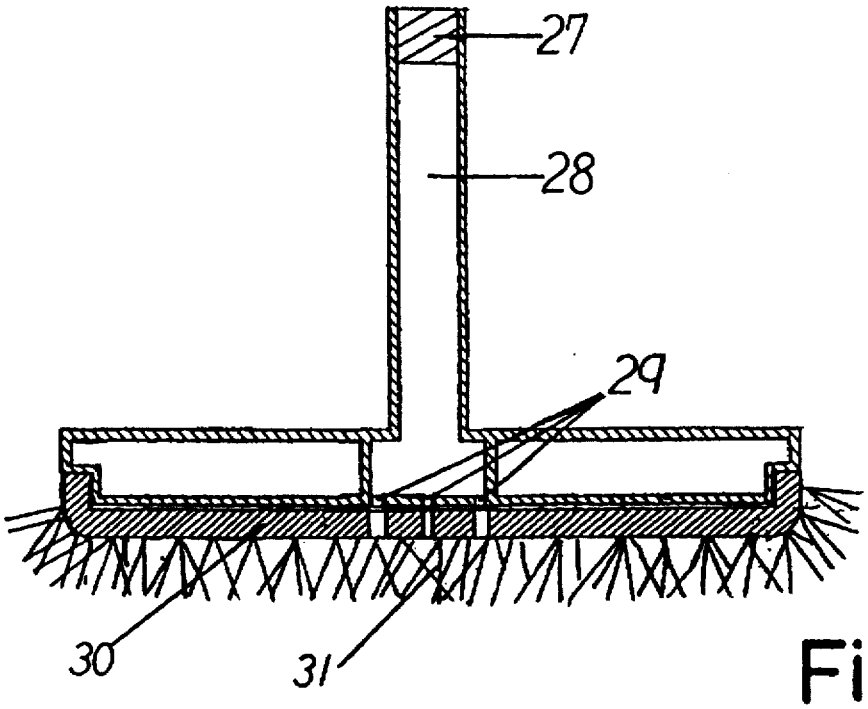
Figure 5B:
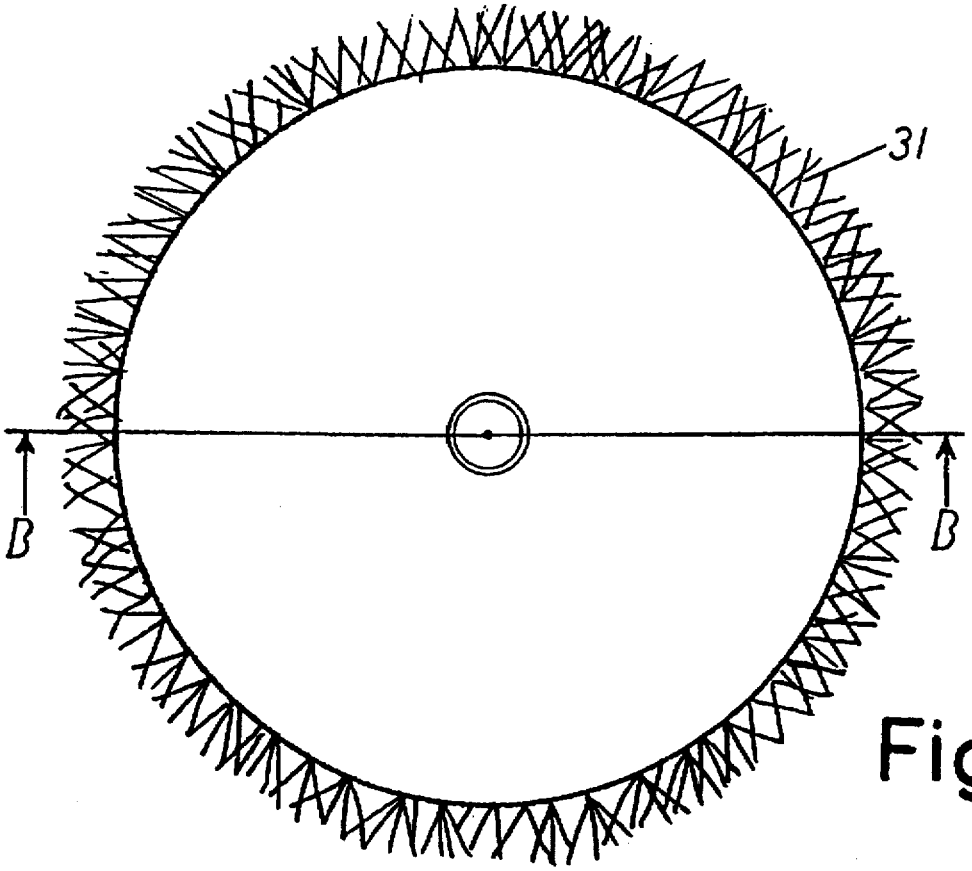

28—Pad mount, intended to allow the ability of changing the kind of scrubbing pad to be used. FIG. 5.

29—Holes, built into the body of each piece (28), FIGS. 5 and 6, to allow the flow of water and detergent. FIG. 5,6.

30—Pad, scrubbing pad provided with body that contains holes to allow flow of water and detergent and brush. FIG. 5.

31—Brushes, built into the pad (30), of different density, rigidity, and material depending on the job sought. Density of the brush is not necessarily shown in drawings. FIG. 5.

Figure 6C:
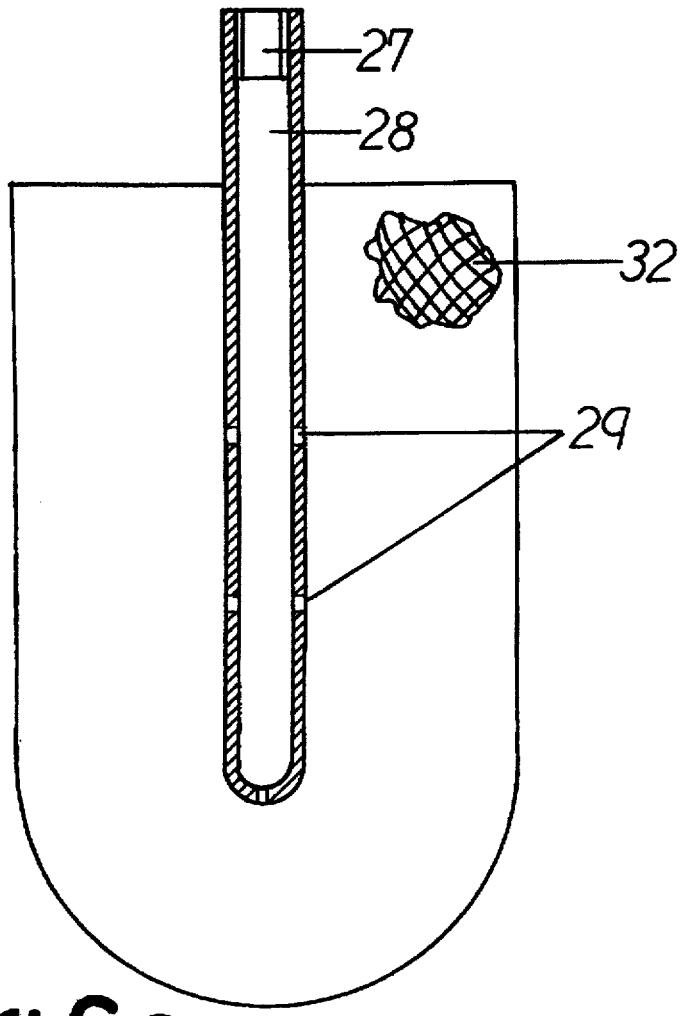
Figure 6A:
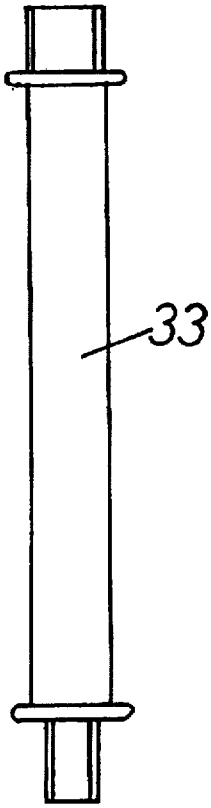
Figure 6B:
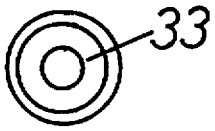
Figure 6D:
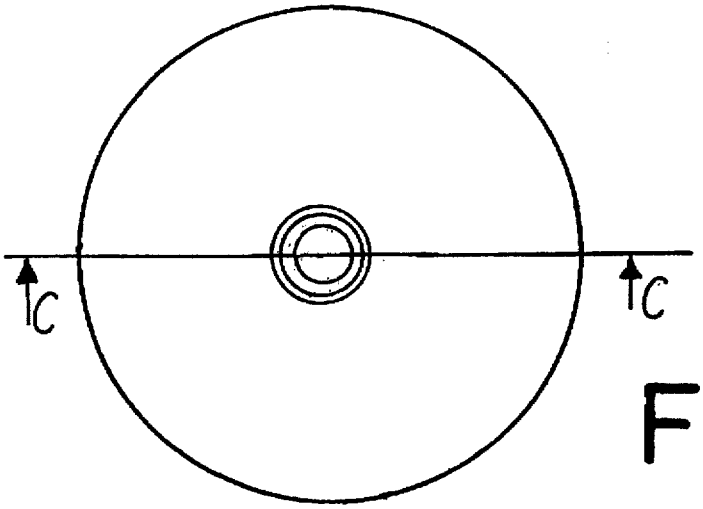

32—Sponge or brushes, for glass cleaning. FIG. 6*a* and 6*b*.

33—Drive shaft extension pipe, intended to elongate the drive shaft pipe (6), for deep scrubbing jobs. FIGS. 6*a* and 6*b*.

34—Splashing outlet, existing on the splash protector cone, to direct the flow away from the operator.

Figure 8A:
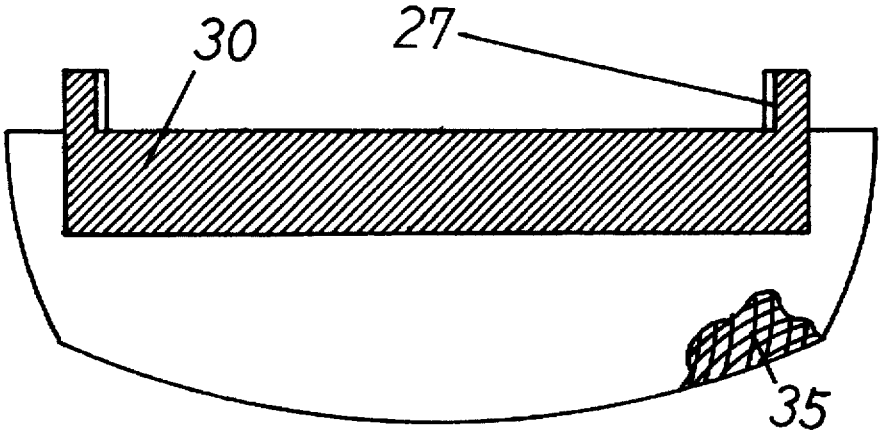
Figure 8B:
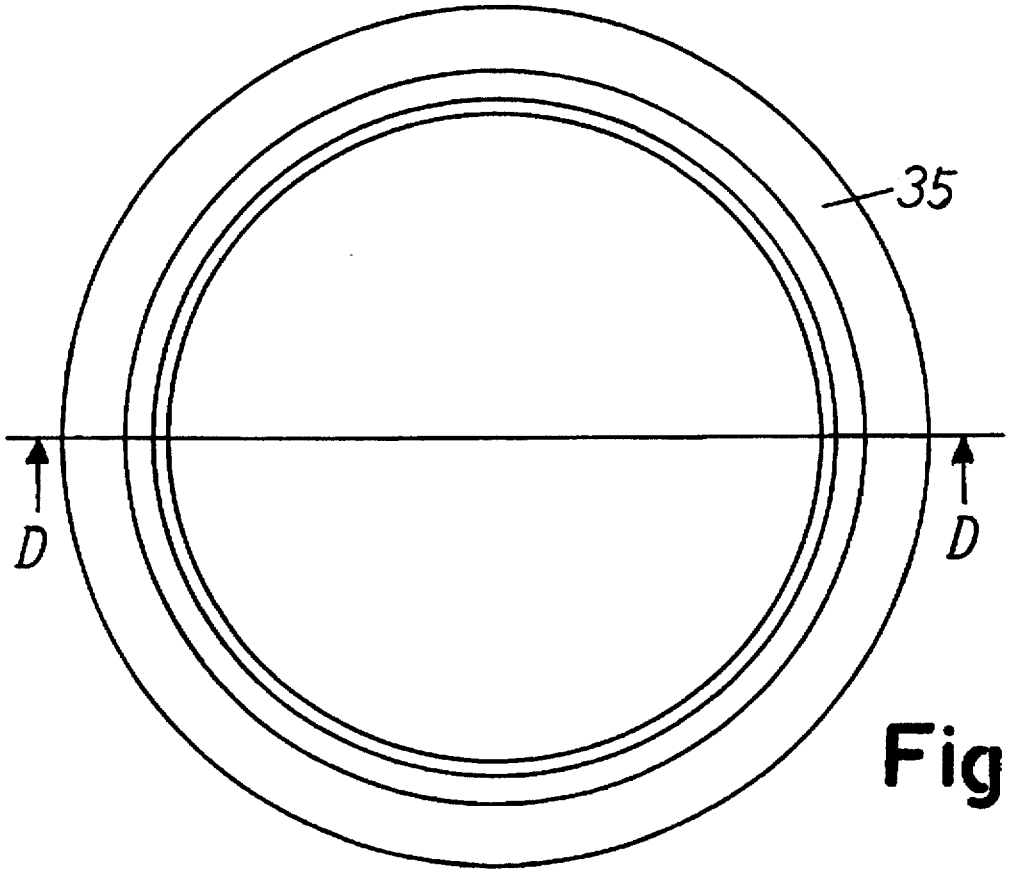

35—Polishing pad sponge, made of two hard sponges to deliver good polishing finish, could be also covered with piece of cloth on top. FIG. 8.

Upon furnishing the components in which it should be looked at and understood carefully I'll proceed in explaining the function of the machine.

FIGS. 1, 2, 3, 4 are all parts of the intended invention, and FIGS. 5–6, 7 and 8 represent the accessories.

This machine with a motor (3) that will deliver the scrubbing rotation through gears (4) and (5) into what I called the drive shaft pipe (6) which in turn provides the rotation to the appropriate scrubbing pad, for example FIG. 5, or to any other accessory intended for the various actions of the machines. This shaft pipe (6) will be able to receive either water and detergent or both, from the top, while maintaining rotation through a valve shown in part number 8,9,19, and 20. This valve is shown in FIG. 2 and is very important and sensitive at the same time because it delivers fluids inside a moving shaft. If leakage is to occur, it can take place outside the sealed case of the machine as shown, FIG. 2. This leakage will take place through holes not shown in drawing, these holes should be administered on the cover cap (19) and its mounting.

FIG. 2 shows the appropriate bearings for the motion described above. These bearing (7) are mounted in the case (1), which consists of two parts bounded together with bolts at various positions (21), and sealed all around with seal (22).

FIG. 4 will explain the water and detergent connection. Water will enter the machine through a durable flexible pipe inlet (10), Water flow will go directly to a manual control valve (24), mounted on the handle for easy operation. Water should be supplied from a mixer plumbing connection with both hot and cold water to deliver warm water suitable for handling. Now the water flow will leave the valve reaching a split connection but forced to go only into the drive shaft pipe (6) by one way restriction valve, represented by number (18). Now for the detergent part, detergent will be sucked from the dispenser (15) by a manual pump (11), and a restriction one way valve (18) inside the dispenser into the delivery point (follow the direction of the arrows). One way valve (18) which is shown in FIG. 3 will allow the operator to deliver detergent outside the machine and into the object being cleaned directly. But if a detergent delivery into the rotating scrubbing pad is demanded, a bypass attachment pipe (26) can be used to deliver the detergent into the water flow through a valve (25), following the arrows in FIG. 4.

The result is a rotating scrubbing pad, FIG. 5, with both water and detergent supply as desired. A splash protector cone is used to direct the flow away from the operator, a water source can become mobile for outdoor jobs and would be achieved by the use of a water tank of a capacity up to five gallons which could be placed on wheels. The connection from this tank into the machine should be similar to the one described before, through the inlet (10) with a flexible pipe. As for dispensing, it could be accomplished by an air pump built into the water tank.

This section will explain the power source for the machine basically supplying the motor with power. The machine is built with rechargeable battery cells mounted in a water-sealed case (16). For full mobility, a spare set of batteries may be provided with the machine, the batteries should be able to supply the motor for at least half an hour. Another source of direct power could be achieved by a power connection (17) through a wire which could carry adequate power to drive the motor, and charge the batteries when the motor is off. This wire should carry a voltage of a direct current of about 9–24 Volts DC. For safety, this wire is fed from a stationary adapter mounted on the wall away from any water source. Choosing the direct current is for safety and the ability to be a substitute for the use of batteries.

Now in the following I'll suggest a split to the drive shaft pipe (6). This split is not included in the drawings. The split is an accessory piece which could be mounted on the machine instead of the splash protector cone, and which receives rotation from the drive shaft pipe (6) splitting the rotation in two different shafts where they can rotate in the opposite direction of each other on the bottom of the machine, one of them clockwise the other counterclockwise. Apart from one another in a distant position, two scrubbing pads can be placed like the one shown in FIG. 5. This split will maintain the flow of water and detergent also from the drive shaft pipe (6). The results of using the split are stability to the scrubbing action where the machine will not tend to pull to one side since the forces are balanced by the usage of two scrubbing pads rotating in an opposite way. The other result is directing the water flow into one side of the machine depending on the two pads position and their rotation.

I would like to give the definition of the verbs, scrub, polish, sand, as the effort made to handle surfaces or materials by the usage of a piece of material that could be called a scrubby, pad, brush, piece of cloth, or sanding paper, made from either natural or artificial material, for the purposes of either cleaning, polishing, smoothing or sanding.

I would like to give the definition of the verbs, scrub, polish, sand, as the effort made to handle surfaces or materials by the usage of a piece of material that could be called a scrubby, pad, brush, piece of clothing's, or sanding paper, made from either natural or artificial materiel, for the purposes of either cleaning, polishing, smoothing or sanding.

I claim the following as my invention:

1. A scrub cleaning machine, comprising:

a housing;

a shaft member rotatably mounted within the housing and having a flow passage and an end extending from the housing;

a scrubbing member attached to the end;

means associated with the housing for rotating the shaft; and means associated with the housing for conveying cleaning fluid through the flow passage to the scrubbing member;

wherein the means for conveying cleaning fluid comprises an inlet fitting non-rotatably mounted to the housing, and means for sealably connecting the inlet fitting to the flow passage whereby cleaning fluid can be supplied through the flow passage to the scrubbing member during rotation of the shaft and the scrubbing member, wherein the housing defines a sealed inner space to substantially prevent against fluid ingress, and wherein the means for sealably connecting the inlet fitting to the flow passage is positioned outside of the housing whereby the inner space of the housing is not exposed to fluids should leakage at the means for sealably connecting occur.

2. A scrub cleaning machine according to claim 1, further comprising a detergent reservoir mounted to the housing; a detergent dispenser for dispensing detergent outside of the housing; and means for selectively directing detergent from the detergent reservoir to the flow passage and to the detergent dispenser.

3. A scrub cleaning machine according to claim 2, wherein the means for selectively directing comprises an attachment pipe adapted for releasable connection between the detergent dispenser and the flow passage.

4. A scrub cleaning machine according to claim 1, wherein the means for rotating comprises a motor mounted within the housing and a power source within the housing for operating the motor.

5. A scrub cleaning machine according to claim 1, wherein the scrubbing member comprises a shaft extension defining a flow path extension, being adapted at one end for connection with the shaft member with the flow path extension communicated with the flow path; and a scrub pad attached to the other end of the shaft extension, the scrub pad having outlet means communicated with the flow path extension whereby cleaning fluid can be applied through the scrub pad directly to a surface being treated.

* * * * *